United States Patent [19]

Thumm

[11] Patent Number: 5,052,098

[45] Date of Patent: Oct. 1, 1991

[54] MEANS FOR REMOVING WIRES FROM BALES IN PARTICULAR WASTE PAPER BALES

[75] Inventor: Helmut Thumm, Heidenheim, Fed. Rep. of Germany

[73] Assignee: J. M. Voith GmbH, Fed. Rep. of Germany

[21] Appl. No.: 510,120

[22] Filed: Apr. 17, 1990

[30] Foreign Application Priority Data

Apr. 18, 1989 [DE] Fed. Rep. of Germany ..... 3912673

[51] Int. Cl.[5] ..... B65B 69/00

[52] U.S. Cl. ..... 29/564.003; 29/33 R; 29/33 F; 29/426.004; 83/909

[58] Field of Search ..... 83/909, 151, 153; 29/564.3, 426.4, 33 R, 33 F

[56] References Cited

U.S. PATENT DOCUMENTS 3,513,522 5/1970 Thomson ..... 83/909 X 4,718,157 1/1988 Keyzers et al. ..... 83/909 X 4,773,148 8/1988 Ohya et al. ..... 83/909 X 4,850,087 7/1989 Gronau ..... 29/564.3 X

*Primary Examiner*—Frank T. Yost

*Assistant Examiner*—Kenneth E. Peterson

*Attorney, Agent, or Firm*—Andrus, Sceales, Starke & Sawall

[57] ABSTRACT

An apparatus for removing binding wire from a bale. The bale containing a plurality of peripheral baling wires is supported on a conveyor and a cutting knife moves vertically along the bale to cut the wires. A pair of gripping knives are located on the opposite side of the bale from the cutting knife and the gripping knives more respectively from the upper and lower ends of the bale toward the vertical midpoint of the bale to gather the cut wires together. The gathered cut wires are engaged by a rotatable winding mechanism which acts to wind the cut wires and remove the wound wires to a discharge site.

2 Claims, 2 Drawing Sheets

MEANS FOR REMOVING WIRES FROM BALES IN PARTICULAR WASTE PAPER BALES

BACKGROUND OF THE INVENTION

The invention relates to a means for removing wires from waste paper bales. Such a means is known from DE-OS 37 07 966. This means provides for two knife beams with a plurality of teeth movable against each other in different directions as cutting device, which interact like the cutters on an electric shaver. The teeth of the knife are intended to be pressed into the waste paper bales in order then to grip the binding wires surrounding the waste paper bales by actuation of the knife beams. This is, however, a very difficult operation which is by no means 100% reliable. When the wires have been securely gripped, they are so accurately positioned by the knife-beam unit that they can get into the slot of a winding cylinder or into the intermediate space formed between two winding pins, if the winding unit is moved at right angles to the wires. For this purpose a very long winding-unit travel path is also necessary in order to grip all wires.

It is the object of the invention to simplify the winding operation and the gripping operation and make them more reliable.

Other different means with similar winding devices are known, but which are on the whole designed in a quite extensive and complicated way, which is why these means are very expensive without being able to guarantee adequate operational reliability and service life (running time) or reliability against susceptibility to repair.

Said problem is solved according to the invention by positioning the bale containing a plurality of peripheral baling wires on a support and a cutting knife is move vertically along the bale to cut or sever the wires. Located on the opposite side of the bale from the cutting knife is a pair of gripping knives, one of which is located at the upper end of the bale and the other at the lower end. After the wires are cut by the cutting knife, the gripping knives are moved in a direction toward each other to gather the cut wires at the central portion of the bale. A winding member is then moved downwardly from an upper storage position and engages the gathered wires. By rotating the winding member, the wires are wound around the winding member and the winding member is then elevated to remove the wound wires to a position where they can be discarded.

DESCRIPTION OF THE DRAWING

The invention is explained below with the aid of the figures in the drawing in a typical embodiment, where.

Figure 1:
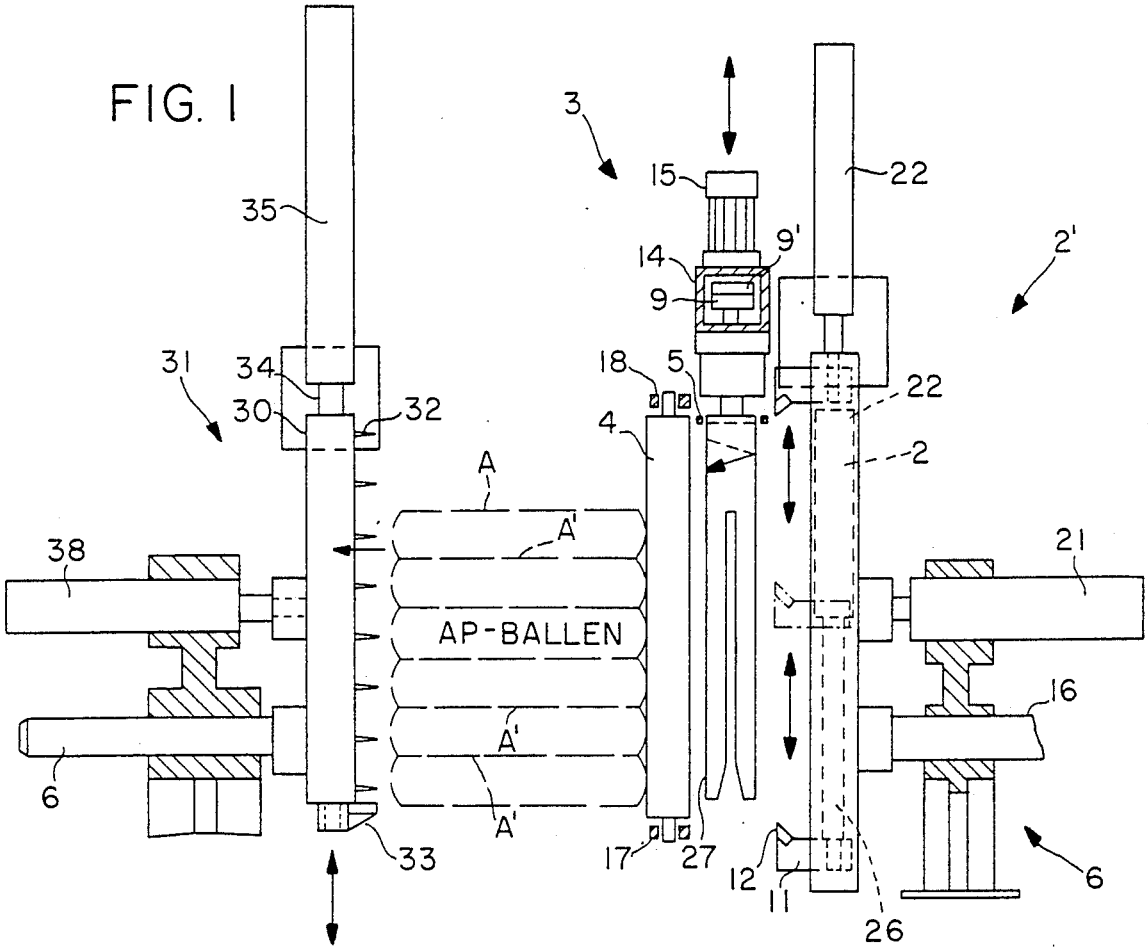
FIG. 1 represents an elevation view showing the apparatus of the invention.
Figure 2:
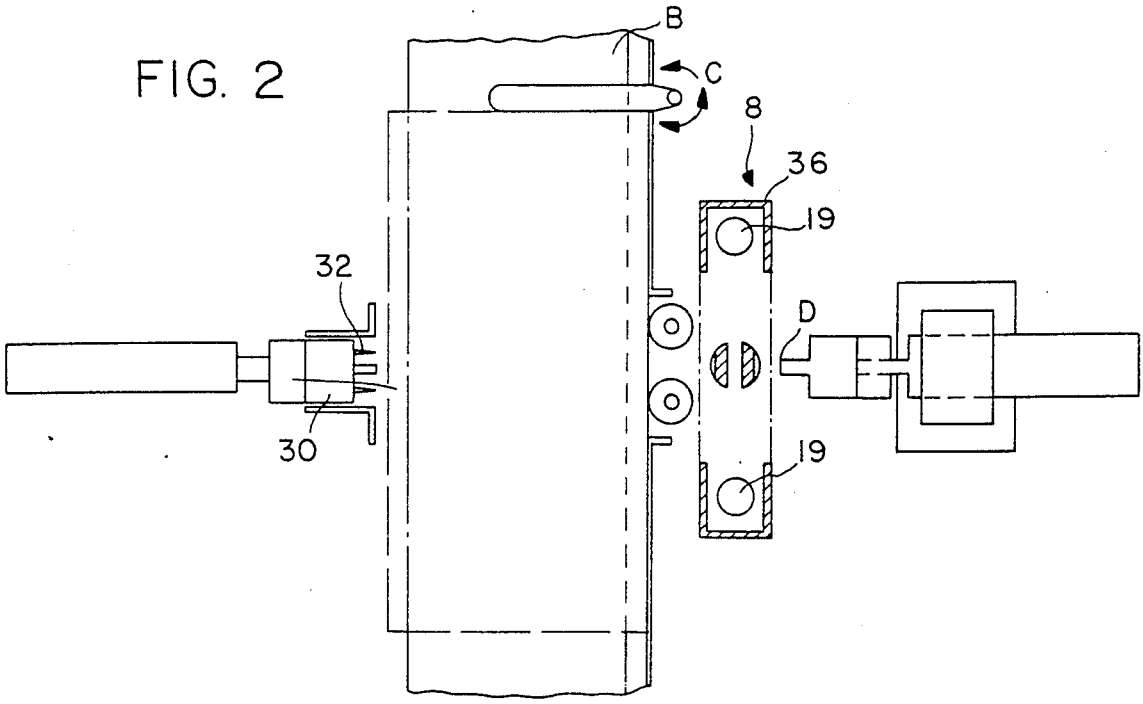
FIG. 2 represents a plan view.

An elongated supporting means 2 is provided for, which serves to hold and guide the knife beam 11 fitted with the knives 12. The knives 12 and their cutting edges are directed against each other and held against each other, i.e. are slidable and movable in opposite directions, in this case by one or one hydraulic piston cylinder unit 22 each, which are attached to the supporting means 2. The knife beams 11 are movable parallel to one side surface—in this case vertical—of the waste paper bale A beside this. Bale A lies on a bale conveyor B. Since the entire cutting and gripping operation for the bale wires takes place very quickly, the bale conveyor does not need to be stopped, but the waste paper bale can be stopped by a lock C, which consists of an arm that can be swung in.

The supporting means 2 exhibits in its longitudinal direction a slot through which the knife beams 11, which are fastened to the cylinder piston rod 26, grip. The supporting means 2' is slidable at right angles to the said lateral surface of the bale by means of hydraulic piston cylinder unit 21, it also being guided by means of tube 16 in a parallel guide unit 6. The winding unit 3 exhibits a frame-shaped winder support 8, to which is also fastened stripping fork 5 for the binding wires wound up by the slotted winding cylinder 27. By means of a supporting bracket 14, the drive motor 15 for the winding cylinder 27 is fastened on the moving part of the winder support and drives the shaft of the winding cylinder 27 through the coupling discs 9 and 9'. Two hydraulic piston cylinder units 19 are used to raise and lower the unit out of electric motor 15, which are arranged on either side of the winder support 8 in its lateral frame sections.

On either side of the sliding plane D at knife beam 11 there is one guide roller 4 each mounted in bearings 18 and 17.

In the initial position the knife beams 11 are positioned in the attitude shown in the drawing in a position above or below the bale A, and then the knives 12 are run against each other, in the course of which they grip the binding wires. After the binding wires have been pulled off by the return movement of the knife beams with the supporting means 2', the wires are positioned relatively accurately by the guide rollers 4, so that the winding cylinder 27 is lowered and the wires can grip at the slot, which are then wound on the winding cylinder. Through the pulling-up of the cylinder the wires are then stripped off the winding cylinder 27 by the stripping fork 5 as a bundle. They fall down and are caught there in a pan.

On the other side of the bale conveyor B is arranged the knife means. This consists of a tube 30 disposed parallel to the winding cylinder or the supporting means 2, with a longitudinal slot on each side of which there is a row of pins 32. A knife beam 33 grips through the slot; the beam is fastened to an actuating rod 34 of the hydraulic piston cylinder unit 35. The tube 30 of the cutting unit 31 is also slidable by means of a hydraulic piston cylinder unit 38 at right angles to the waste paper bale, with a previously described parallel guiding unit 6 also being provided.

In a similar way as in the case of the knife beam 11, here, too, a knife beam 33 is positioned below the waste paper bale before it runs into it, in order to cut the binding wires at the pins 32 serving as abutments. The penetration depth should be approx. 50 mm in each case so as also to securely grip wires that have penetrated deeply.

Prior to the start of the working stroke the knife beams 11 and 12 or 13 must be positioned non completely under or above the waste paper bale before they run into the same. For in this case the slat conveyor B would have to be relatively narrow for the bale A, so that the bales project with their longitudinal edges over the bale conveyor. It also sufficient if the knife beams are positioned so that they are pressed into the bales below the lowest or above the highest binding wire, in order only then to begin the working stroke (e.g. cutting stroke). This is readily possible, since the waste paper bales are pressed relatively loosely so that they do not offer too great a resistance to a penetration of the knife beams into the bales.

Figure 3:
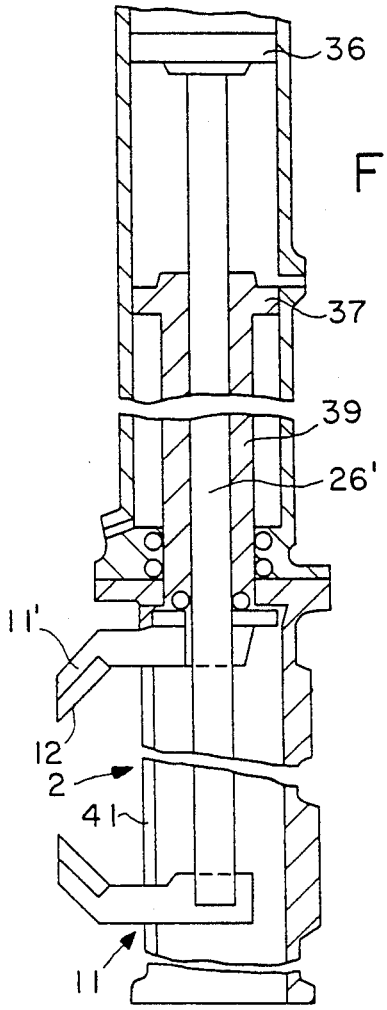
FIG. 3 represents a detail of a double-acting hydraulic cylinder.
Figure 4:
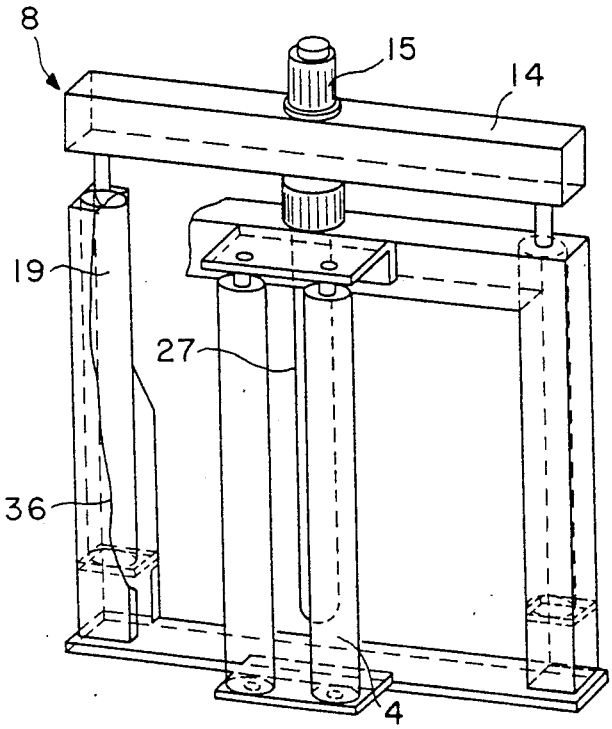
FIG. 4 is a perspective view showing the rollers and the mechanism for raising and lowering the winding member.

FIG. 3 shows a double-acting hydraulic piston cylinder unit, with two pistons 36 and 37 actuating piston rods 26' and 39 respectively, to which knife beams 11 and 11' respectively are attached. Then the knife beams 11 and 11' run readily towards each other in line and in the longitudinal slot 41 of the support 2.

It is however, readily possible to use in each case one single-acting hydraulic piston cylinder unit for each knife beam 11 or 11', which are fastened one beside the other on support unit 2'. Then either the ends of the piston rod or the knife beams must each be designed to be offset.

I claim:

1. An apparatus for removing binding wire from a bale, comprising a support to support a bale containing a plurality of peripheral baling wires, said support having first and second sides, said bale being positionable between said first and second sides, cutting means disposed adjacent a first side of said support for cutting said wires, a pair of vertical guide members disposed in spaced relation adjacent a vertical guide members disposed in spaced relation adjacent a second side of said support, gripping means disposed adjacent the second side of said support, said gripping means comprising a pair of gripping knives movable horizontally from an outer position to an inner position where said gripping knives extend through the space between said guide members and into contact with said bale, first drive means for moving said gripping knives between the outer position and the inner position, said gripping knives also being movable between a first position where one of said knives is located adjacent an upper end of the bale to a second gathering position where said knives are located adjacent each other at a central portion of said bale, second drive means for moving the gripping knives between said first position and said second position to thereby gather the cut wires at the central portion of the bale, subsequent movement of said gripping knives from the inner position to the outer position drawing the gathered wire outwardly through the space between said guide members, rotatable winding means for engaging the gathered wires, said winding means being mounted for movement in a vertical path between an upper storage position where said winding means is located above the bale and a winding position where the winding means is located outwardly of and aligned with the space between said guide members, and third drive means for rotating said winding means to wind said cut wires on said winding means.

2. The apparatus of claim 1, wherein said cutting means comprises a plurality of vertically spaced pins which are insertable in said bale, and a cutting knife movable in a direction transverse of said wires to cut said wires while said wires are held by said pins.

* * * * *

UNITED STATES PATENT AND TRADEMARK OFFICE

CERTIFICATE OF CORRECTION

PATENT NO. : 5,052,098

DATED : October 1, 1991

INVENTOR(S) : HELMUT THUMM

It is certified that error appears in the above-identified patent and that said Letters Patent is hereby corrected as shown below:

Col. 3, Line 29, CLAIM 1, After "a", delete "vertical guide members disposed in spaced relation adjacent a"

Signed and Sealed this

Ninth Day of November, 1993

*Attest:*

*Attesting Officer*

Bruce Lehman

BRUCE LEHMAN

*Commissioner of Patents and Trademarks*